US008910573B2

(12) United States Patent
Elter et al.

(10) Patent No.: US 8,910,573 B2
(45) Date of Patent: Dec. 16, 2014

(54) METHOD FOR CONTROLLING AN INKING UNIT OF A PRINTING PRESS

(75) Inventors: Peter Elter, Mühlhausen (DE); Nikolaus Pfeiffer, Heidelberg (DE); Bernhard Buck, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 374 days.

(21) Appl. No.: 12/774,750

(22) Filed: May 6, 2010

(65) Prior Publication Data

US 2010/0282103 A1 Nov. 11, 2010

(30) Foreign Application Priority Data

May 7, 2009 (DE) ..... 10 2009 020 364

(51) Int. Cl.
*B41F 31/04* (2006.01)

(52) U.S. Cl.
CPC ..... *B41F 31/045* (2013.01); *B41P 2233/30* (2013.01); *Y10S 101/47* (2013.01)
USPC ..... 101/484; 101/365; 101/DIG. 47

(58) Field of Classification Search
USPC ..... 101/365, 485, 484, DIG. 47
See application file for complete search history.

(56) References Cited

U.S. PATENT DOCUMENTS 5,174,210 A 12/1992 Rodi et al.
5,806,429 A 9/1998 Laubmann
6,055,907 A * 5/2000 Endisch et al. ..... 101/484
6,318,260 B1 11/2001 Chu et al.
6,536,341 B2 3/2003 Shiki et al.
6,546,870 B2 4/2003 Mayer et al.
6,561,098 B2 5/2003 Mayer et al.
6,622,626 B2 9/2003 Stuhlmiller et al.
6,732,645 B2 * 5/2004 Yamamoto et al. ..... 101/365
7,114,441 B2 10/2006 Shiki
7,551,317 B2 6/2009 Engler et al.
7,634,964 B2 12/2009 Masuch (Continued)

FOREIGN PATENT DOCUMENTS

CN 1575982 A 2/2005
CN 1960874 A 5/2007

(Continued)

OTHER PUBLICATIONS

German Search Report dated Jan. 15, 2010.

*Primary Examiner* — Ren Yan
*Assistant Examiner* — Leo T Hinze
(74) *Attorney, Agent, or Firm* — Laurence A. Greenberg; Werner H. Stemer; Ralph E. Locher

(57) ABSTRACT

A method for controlling an inking unit of a printing press, includes resetting an ink metering element from first to second metered quantities for an intended inking level. The metering element is set to a temporary, third metered ink quantity by a control unit, for a time interval, during a non-steady phase of the inking unit before reaching the intended level. A value of a variable characterizing the inking state of printing material is determined and a plurality of sets of values for the variable are predefined, into which the determined value can be grouped. The temporary metering quantity is carried out: at a first rate and/or during a first time period if the value of the variable lies in a first set of values, and at a second rate and/or in a second time period if the value of the variable lies in a second, different set of values.

4 Claims, 4 Drawing Sheets

(56) References Cited

U.S. PATENT DOCUMENTS

| | | | |
|---|---|---|---|
| 7,864,979 | B2 | 1/2011 | Fan et al. |
| 7,894,065 | B2 | 2/2011 | Kohlbrenner et al. |
| 8,001,898 | B2 | 8/2011 | Tuerke et al. |
| 2001/0018875 | A1 | 9/2001 | Shiki et al. |
| 2007/0157840 | A1 | 7/2007 | Mayer |
| 2007/0283830 | A1 | 12/2007 | Pfeiffer |

FOREIGN PATENT DOCUMENTS

| | | | |
|---|---|---|---|
| CN | 100999151 | A | 7/2007 |
| CN | 101073941 | A | 11/2007 |
| DE | 3904301 | A1 | 8/1990 |
| DE | 4013463 | A1 | 11/1991 |
| DE | 19615156 | A1 | 10/1997 |
| DE | 10032765 | A1 | 4/2001 |
| DE | 10056246 | A1 | 6/2001 |
| DE | 10056247 | A1 | 6/2001 |
| DE | 10109198 | A1 | 9/2001 |
| DE | 10106986 | A1 | 9/2002 |
| DE | 102007019471 | A1 | 11/2007 |
| JP | 2008182702 | A | 8/2008 |
| WO | 2007110317 | A1 | 10/2007 |

* cited by examiner

METHOD FOR CONTROLLING AN INKING UNIT OF A PRINTING PRESS

CROSS-REFERENCE TO RELATED APPLICATION

This application claims the priority, under 35 U.S.C. §119, of German Patent Application DE 10 2009 020 364.8, filed May 7, 2009; the prior application is herewith incorporated by reference in its entirety.

BACKGROUND OF THE INVENTION

Field of the Invention

The invention relates to a method for controlling an inking unit of a printing press having at least one ink metering element and a control unit, the ink metering element being reset from a first metered quantity of ink to a second metered quantity of ink for an intended level of inking to be achieved, and the ink metering element being set to a temporary, third metered quantity of ink by the control unit, at least for one time interval, during a non-steady phase of the inking unit before the intended level of inking is reached. The invention also relates to a corresponding printing press.

Inking units as parts of printing units of printing presses, in particular planographic printing presses or offset printing presses, exhibit a certain reaction time when they are changed or reset from a first steady state, in which a first level of inking of a printing material is achieved, to a second steady state, in which a second level of inking of a printing material is achieved. In other words, starting from an old steady state, a new steady state cannot be achieved instantaneously but only after a certain transient time interval or a non-steady phase of the inking unit. In order to accelerate the inking unit reaction, that is to shorten the reaction time, it is known to perform an exaggerated adjustment of the ink metering element(s) of the inking unit for a short time, in particular during the non-steady phase, so that a different quantity of ink than in the first and also than in the second state is temporarily introduced into the inking unit. Depending on the objective to be achieved, the exaggerated adjustment is a considerable overshoot or a considerable undershoot of the requisite supply of the quantity of ink in the second steady state. In that way, to achieve a second steady state with a higher application of ink, an additional quantity of ink is introduced into the inking unit or, to achieve a second steady state with a reduced application of ink, an excess quantity of ink leaves the inking unit due to a reduced supply.

For example, German Published, Non-Prosecuted Patent Application DE 100 56 247 A1, corresponding to U.S. Pat. No. 6,546,870, discloses a method for controlling the quantity of ink in a zonal inking unit of a printing press. For each of the inking zones, corrective flows of quantities of ink are introduced during a transition time interval when the desired value of the quantity of ink to be discharged to the inking zone is changed from a first to a second value. Due to distribution of the quantity of ink introduced into the inking unit, the quantities of ink in the individual inking zones are not independent of one another. Therefore, further corrective flows of quantities of ink are provided, which compensate for the lateral flow of ink between adjacent inking zones during the transition time interval.

Furthermore, German Published, Non-Prosecuted Patent Application DE 10 2007 019 471 A1, corresponding to U.S. Patent Application Publication No. US 2007/0283830 A1 discloses, in such a method for controlling the quantity of ink of an inking unit, processing a value of a current actual level of inking during the non-steady phase of the inking unit for the determination of the temporary metering of the quantity of ink, with it being possible for that value to be non-steady and to be extrapolated into the future, so that the inking unit reaction can be accelerated.

In the methods described, the respective intensity of the transient supply of ink during the transition time interval is defined by the initial state, the first steady state and the final state, the second steady state and, in the case of a practical ink metering difference, is always the same. As a result of the short-term overcontrol, the desired intended level of inking is reached relatively quickly. However, in some situations, undesired secondary effects can occur, such as the level of inking overshooting beyond the final state. During the transient supply of ink, individual prints, in particular on individual sheets, can have a different level of inking (inking gradient, inking difference or inking spread). A large inking gradient can be detectable visually and possibly felt to be a deficiency.

SUMMARY OF THE INVENTION

It is accordingly an object of the invention to provide a printing press and a method for controlling an inking unit of a printing press, which overcome the hereinafore-mentioned disadvantages of the heretofore-known devices and methods of this general type and which reduce or minimize an inking gradient occurring between individual prints during a non-steady phase.

With the foregoing and other objects in view there is provided, in accordance with the invention, a method for controlling an inking unit of a printing press, in particular an offset printing press, having at least one ink metering element and a control unit. According to the method of the invention, the ink metering element is reset from a first metered quantity of ink, in particular a first size of the opening of the ink metering element, to a second metered quantity of ink, in particular a second size of the opening of the ink metering element, for an intended level of inking to be achieved. The ink metering element is set to a temporary, third metered quantity of ink by the control unit, at least for one time interval, during the non-steady phase of the inking unit before the intended level of inking is reached. A value of a variable characterizing the inking state of the printing material, in particular of the sheet, is determined and a plurality of sets of values for the variable are predefined, into which the determined value of the variable can be grouped. The temporary metering of the quantity of ink is carried out at a first rate and/or during a first time period if the value of the variable lies in a first set of values, and is carried out at a second rate, which is different from the first rate, and/or in a second time period, which is different from the first time period, if the value of the variable lies in a second set of values, which is different from the first set of values.

Advantageously, according to the invention the transient supply of ink can be configured as a function of the inking situation: the variable can be used as a measure of the distance of the present level of inking to the intended level of inking to be achieved. If the determined value of the variable lies in a first set of values, which covers states at a large distance from the intended level of inking, an attempt can be made to reach the intended level of inking quickly through the use of comparatively large metering changes. If, on the other hand, the determined value of the variable lies in a second set of values, which covers states at a small distance from the intended level of inking, the most gentle variation of the level of inking possible can be made through the use of comparatively small metering changes.

According to the invention, in other words, the quantity of ink in the inking unit is controlled, for a short time (signed) with an overcontrol (overshooting or undershooting) being carried out. Stated in another way, a class assignment is performed for the variable of which a value is determined: the determined value is classified or allocated into a plurality of sets of values. In accordance with the classification carried out, specific metering of a quantity of ink at a specific rate and/or in a specific time period is carried out. The metered quantities of ink are differentiated between the individual classes or, respectively, different metering of quantities of ink is carried out in the individual classes.

The inking state of the printing material, in particular of the sheet, is in particular the current inking state, for example during the first steady state. The inking unit can have a plurality of ink metering elements. An ink metering element can, in particular, be an ink knife, an ink slide, a cartridge, a metering eccentric or a metering cylinder. The third metering of a quantity of ink is carried out as a consequence of an exaggerated adjustment of the size of the opening of the ink metering element.

In accordance with another mode of the invention, in practical embodiments of the method, the variable can come from the following group of selected process variables: inking deviation, elapsed time since inking change, good sheet counter reading, change in the printing speed, elapsed time since a change in the printing speed, number of sheets since a change in the printing speed, change in the dampening, elapsed time since a change in the dampening, number of sheets since a change in the dampening, register adjustment, elapsed time since a register adjustment, number of sheets since a register adjustment.

The variable can be designated as a measure of the sheet state, more precisely its inking state.

In accordance with a further mode of the method of the invention, the first rate and/or the second rate can be constant.

In accordance with an added mode of the invention, as an alternative thereto or in addition, in the method for controlling an inking unit of a printing press, the first time period of the time interval for the temporary metering of a quantity of ink can have a first length when the value of the variable lies in the first set of values, and the second time period of the time interval for the temporary metering of a quantity of ink can have a second length which is greater than the first length. In particular, the integral of the first rate over the first time period of the time interval can be substantially equal to the integral of the second rate over the second time period of the time interval. The same quantity of ink then advantageously reaches the inking unit.

In accordance with an additional, preferred mode of the method of the invention, three mutually different sets of values are predefined: the temporary metering of a quantity of ink is carried out at a first rate when the value of the variable lies in the first set of values, it is carried out at a second rate, which is smaller than the first rate, when the value of the variable lies in the second set of values, and the temporary metering of a quantity of ink is substantially identical to the second metering of a quantity of ink when the value of the variable lies in the third set of values.

In accordance with yet another mode of the method of the invention, as an alternative to the process variables listed, the variable can be a number for identifying the state, with the number being determined, by considering a process variable, in particular one of the process variables listed above, for which a value has been determined and a plurality of sets of values, into which the respectively determined value of the process variable can be grouped, are predefined, in such a way that each of the predefined sets of values is assigned a numerical value, which is allocated to the number for identifying the state.

In accordance with yet a further mode of the method of the invention, alternatively once more, the variable can be a number for identifying the state, the number being determined, by considering a plurality of process variables, in particular a plurality of the process variables listed above, to which in each case a number identifying the state of the process variable is assigned, in such a way that the number for identifying the state is allocated that numerical value which is given by the weighted or unweighted average of the plurality of identifying numbers or as an extreme value of the identifying numbers. In this case, it is preferred for the allocation of the numbers identifying the process variables to be carried out in such a way that, for each of the process variables, a plurality of sets of values for the grouping of specific values of the process variable is predefined, with each of the predefined sets of values being assigned a numerical value which is allocated to the number identifying the process variables.

The practical predefinition of the sets of values for the variable, which means the division of the value space of the variable into a plurality of sets of values, and also the quantitative definition of the practical measure upon the occurrence of a value of the variable from a specific set of values, can be based on experience with the inking unit or on experiments. In a further development, an analysis of the data is carried out through the use of a connected expert system, so that optimized divisions and/or measures are found.

The printing press, in which the method according to the invention is employed, can be a direct or indirect planographic printing press, in particular an offset printing press. The printing press can, in particular, be a sheet-processing machine. The printing press is preferably a sheet-processing offset printing press. The printing materials that are processed can in particular be paper, paperboard, board or organic polymer film. The printing press can include a feeder, a plurality of printing units, in particular four, six, eight, ten or twelve offset printing units, and a delivery. Furthermore, the printing press can also have further units, such as a punching unit or a varnishing unit.

With the objects of the invention in view, there is concomitantly provided a printing press, comprising a control computer and at least one offset printing unit. The printing press according to the invention having a control computer and at least one offset printing unit, includes a computer program product running on the control computer, which can be loaded directly into the internal memory of the control computer of the printing press and/or stored on a medium belonging to the control computer, and which includes software code sections with which all of the steps of a method having the steps or combinations of steps of the invention are executed.

Other features which are considered as characteristic for the invention are set forth in the appended claims.

Although the invention is illustrated and described herein as embodied in a printing press and a method for controlling an inking unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
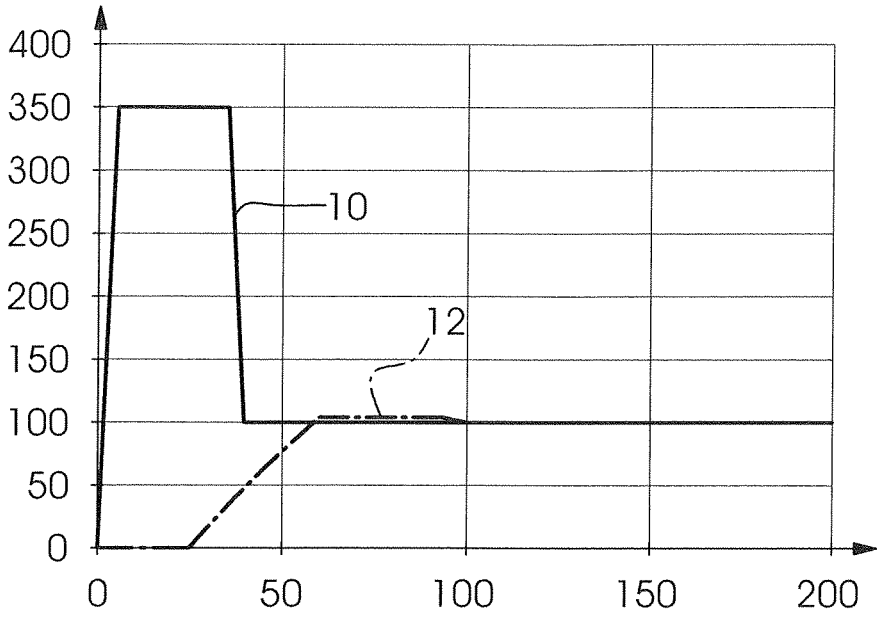
FIGS. 1A and 1B are graphs showing an example of an inking overshoot and its effect on the normalized density and the inking gradient for the case of a specific value of the variable in a first value range.

Referring now to the series of appended figures of the drawings in detail, there is seen, in examples, a preferred embodiment of the method according to the invention for a sheet-fed printing press having inking zones. In this embodiment, three sheet states, namely not saleable, saleable and close to the machine or process tolerance, are distinguished. Depending on the sheet state, the following inking overcontrol is carried out: in the "not saleable" state, the intended inking is to be achieved as quickly as possible. If appropriate, a slight overswing is also tolerated. In the "saleable" state, despite rapidly reaching the intended inking, the density gradient is intended to be small. Likewise, no overswings are to occur. In the "close to the process tolerance" state, no inking overcontrol is carried out, the density gradient is minimized. Provision is made for the states to be detected automatically. Automatic adaptation of the inking overcontrol is then carried out. In a further development, on top of everything, smooth transitions take place between the individual states.

In the preferred embodiment, the sheet states, more precisely the inking states, are determined in accordance with the following rules. If the inking deviation lies within the machine tolerance, quantitatively below 3%, this is the sheet state "close to the process tolerance." The process tolerance can also be determined (and adapted) additionally through the use of tracking measurements during continuous printing. If the inking deviation lies below a threshold value, in practical terms below n times the process tolerance, quantitatively for example below twice the process tolerance 6%, this is the sheet state "saleable." This threshold value can also additionally be determined automatically. In one development, the printing press can also learn the threshold value automatically, by a variable being derived from the measured inking before and after the starting of the edition counter during the preceding print job. If, for example, the next to the last inking level before the edition counter was 6%, then the threshold value can be set to this value. In a further refinement, this value can also be derived from a plurality of print jobs, for example through the use of averaging. If the inking deviation lies above the threshold value, then the sheet state is "not saleable."

In the preferred embodiment, the actual determination of the sheet state is then carried out in such a way that, firstly, a mean inking deviation is determined with a measuring instrument. If the value determined is smaller than the process tolerance, then the sheet state is "close to the process tolerance." If this is not the case, the value is compared with n times the process tolerance as a threshold value. If the value determined is smaller than this threshold value, then the sheet state is "saleable." If not, then the sheet state is "not saleable."

If no measuring instrument is used or can be used, the decision as to what sheet state is present can also be carried out by using a good sheet counter: If the latter is switched on, then the sheet state is "saleable." If, on the other hand, the good sheet counter is switched off, then the sheet state is "not saleable." As an alternative to this, without a measuring instrument, the desired inking change can also be derived from the adjustment of the ink metering element. In the simplest case, the determination of the inking change can be carried out linearly/proportionally, i.e. 10% of the ink metering element adjustment corresponds to an inking change of 10%. If, in addition, the actual inking, the metering behavior or the like are also to be taken into account, the relationship becomes more complex but can be predicted unambiguously in an appropriate model.

In the preferred embodiment, the individual inking overshoots are defined as follows. For the "not saleable" sheet state, a first overshoot is carried out with a first intensity (exaggerated or straightforward) and/or in a first time period (short). For the "saleable" sheet state, a second overshoot is carried out with a second intensity (straightforward or reduced), which is lower than the first intensity, and/or in a second time period (medium), which is longer than the first time period. For the sheet state "close to the process tolerance", no overshoot is provided but a straightforward adjustment of the ink metering element is carried out. From the relationship described in this illustration it is clear that the quantity of the overshoot depends, amongst other things, on the inking deviation between the first and the second steady state, the printed area coverage and the construction of the inking unit.

Without any measuring instrument and without an approximate calculation, the sheet states "saleable" and "close to the process tolerance" coincide. This means that the second overshoot is then always carried out.

Figure 1B:
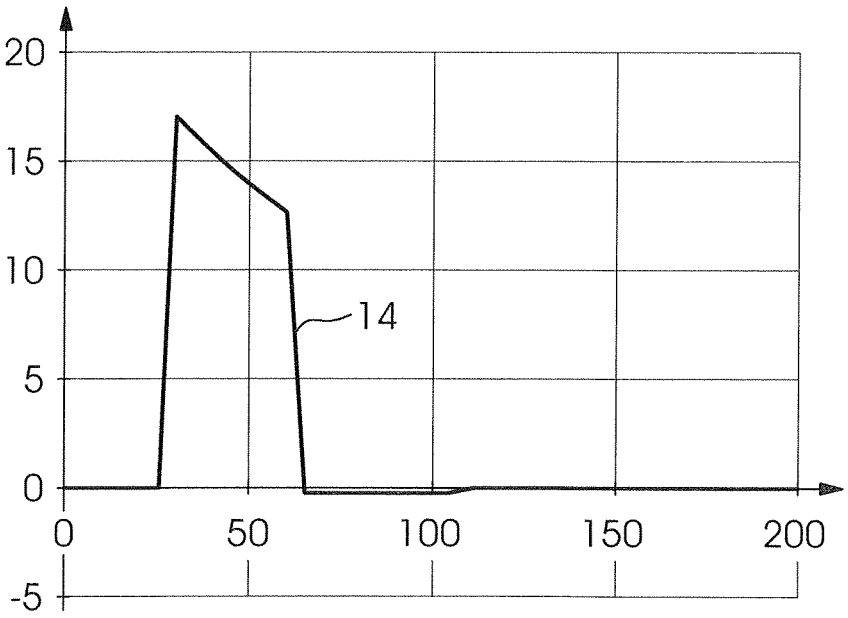

FIG. 1 shows an example of an inking overshoot and its effect on the normalized density and the inking gradient in the case of a specific value of the variable in a first value range, in practical terms for the preferred embodiment when the sheet state is "not saleable." In FIG. 1A, a normalized inking zone opening difference 10 in relation to the inking zone opening in the first steady state (initial state) and a normalized density difference 12 are shown as a function of time, measured in the number of printed sheets. As described above, in this sheet state a first overshoot at the level of 3.5 times the final value in a short time period of about 30 sheets is carried out. This overshoot is then taken back to the level of the inking zone opening for the second steady state (final state). The density difference 12 approaches monotonically that in the final state. The latter is reached after about 60 sheets. In FIG. 1B, a density gradient 14 is illustrated as a function of the time, measured in the number of printed sheets. The density gradient 14 occurs with a time delay in relation to the inking overshoot carried out. The resultant inking spread is irrelevant in practice, since these are in any case non-saleable sheets.

Figure 2A:
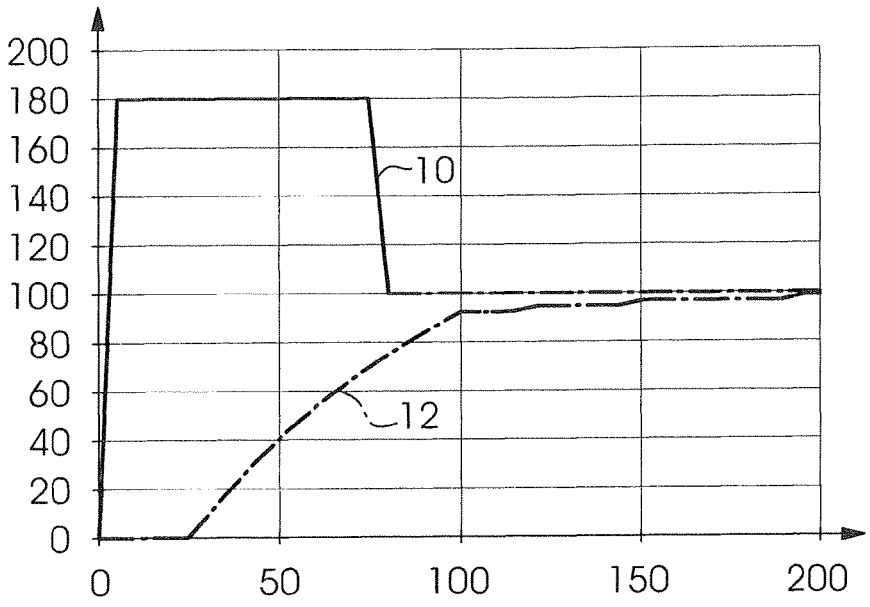
FIGS. 2A and 2B are graphs showing an example of an inking overshoot and its effect on the normalized density and the inking gradient for the case of a specific value of the variable in a second value range.
Figure 2B:
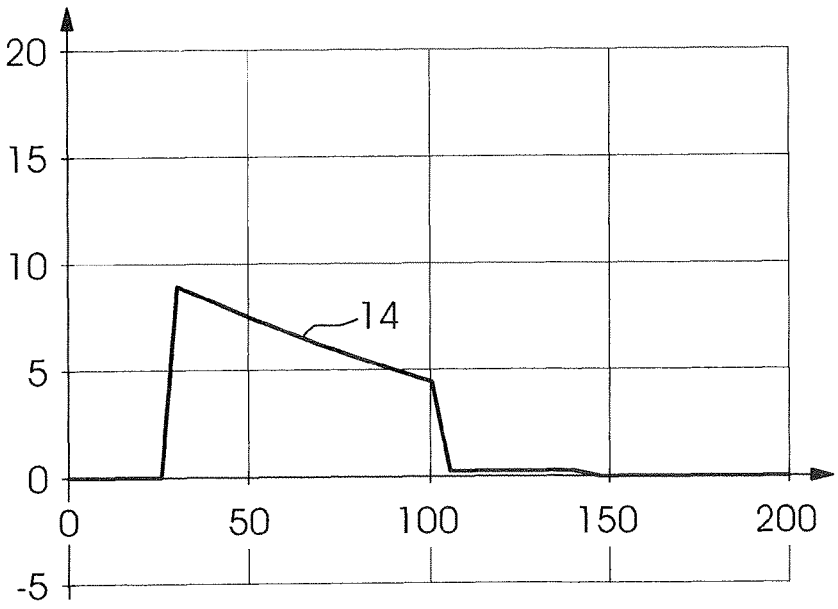

FIG. 2 illustrates an example of an inking overshoot and its effect on the normalized density and the inking gradient for the case of a specific value of the variable in a second value range, in practical terms for the preferred embodiment when the sheet state is "saleable." In FIG. 2A, once more the normalized inking zone opening difference 10 in relation to the inking zone opening in the first steady state (initial state) and the normalized density difference 12 are shown as a function of time, measured in the number of printed sheets. As described above, in this sheet state a second overshoot at the level of 1.8 times the final value over a long time period of about 60 sheets is carried out. This overshoot is then taken back to the level of the inking zone opening for the second steady state (final state). The density difference 12 approaches monotonically that in the final state. The latter is reached after about 120 sheets. In FIG. 2B, the density gradient 14 is illustrated as a function of time, measured in the number of printed sheets. As already mentioned in the case of the "not saleable" sheet state, the density gradient 14 occurs with a time delay in relation to the inking overshoot carried out, approximately at the same time. However, the density gradient 14 can be observed to be longer. The resultant inking spread is considerably lower as compared with that in FIG. 1B, approximately only half as severe.

Figure 3A:
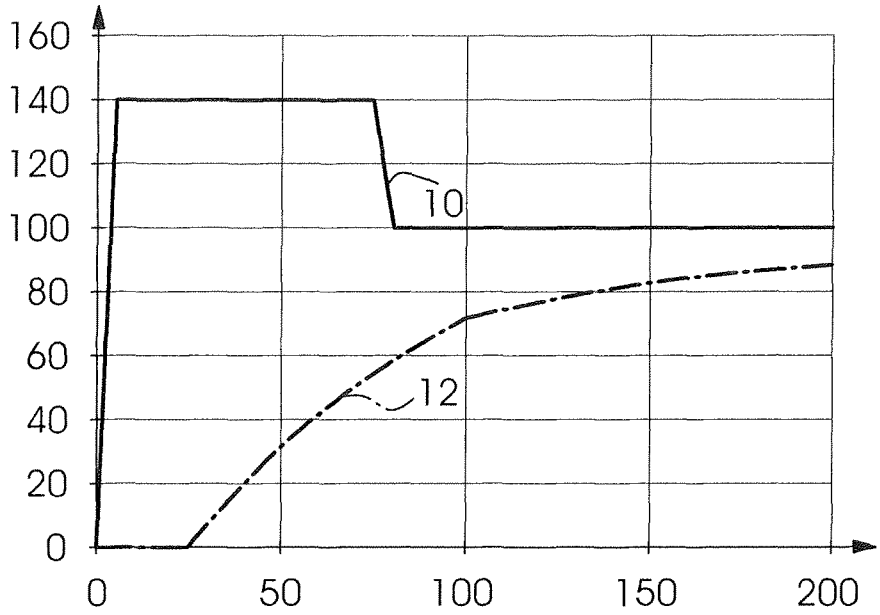
FIGS. 3A and 3B are graphs showing a measure, alternative to that in FIG. 2, of another example of an inking overshoot and its effect on the normalized density and the inking gradient for the case of a specific value of the variable in a second value range.
Figure 3B:
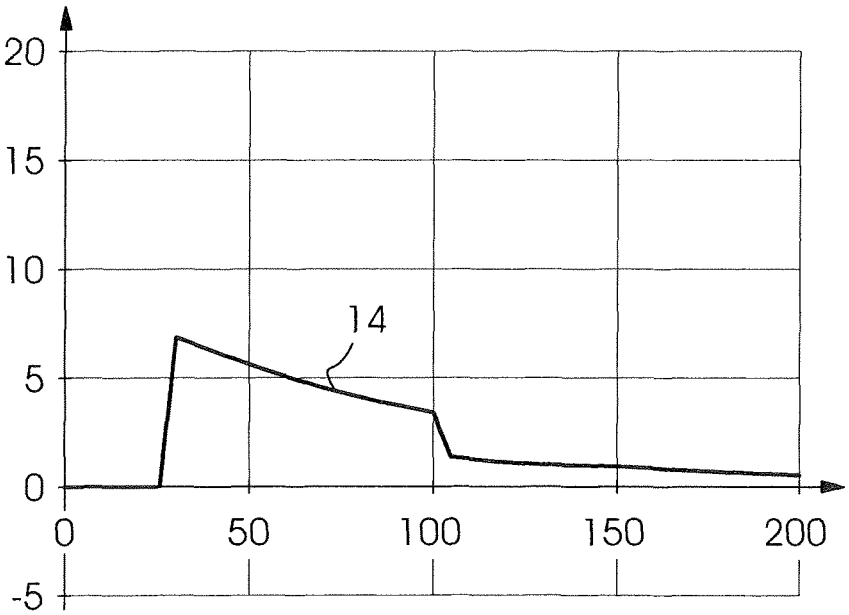

FIG. 3 relates, as an alternative to the measure shown in FIG. 2, to another example of an inking overshoot and its effect on the normalized density and the inking gradient in the case of a specific value of the variable in the second value range, in practical terms for the preferred embodiment when the sheet state is "saleable." Once more, the normalized inking difference 10 and the normalized density 12 are shown as a function of time, measured in the number of printed sheets, in FIG. 3A. The overshoot is now provided at a level of 1.4 times the final value in a long time period of about 60 sheets. The density difference 12 approaches the final state monotonically considerably more slowly than the situation shown in FIG. 2. At the same time, however, as compared with the situation of FIG. 2, a further-reaching considerable reduction in the density gradient 14 is reached, as shown in FIG. 3B, as a function of time, measured in the number of printed sheets.

Figure 4A:
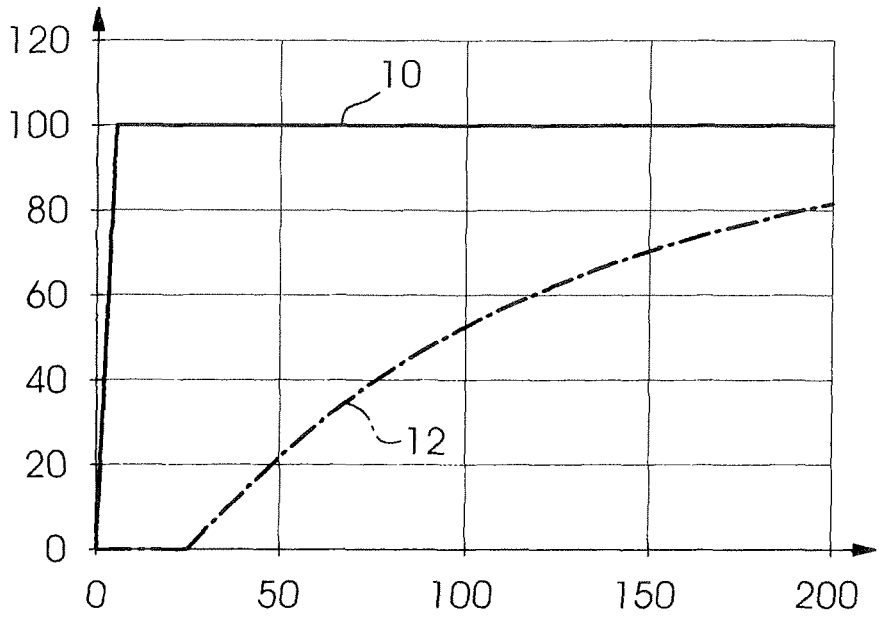
FIGS. 4A and 4B are graphs showing an example of an inking overshoot and its effect on the normalized density and the inking gradient for the case of a specific value of the variable in a third value range.
Figure 4B:
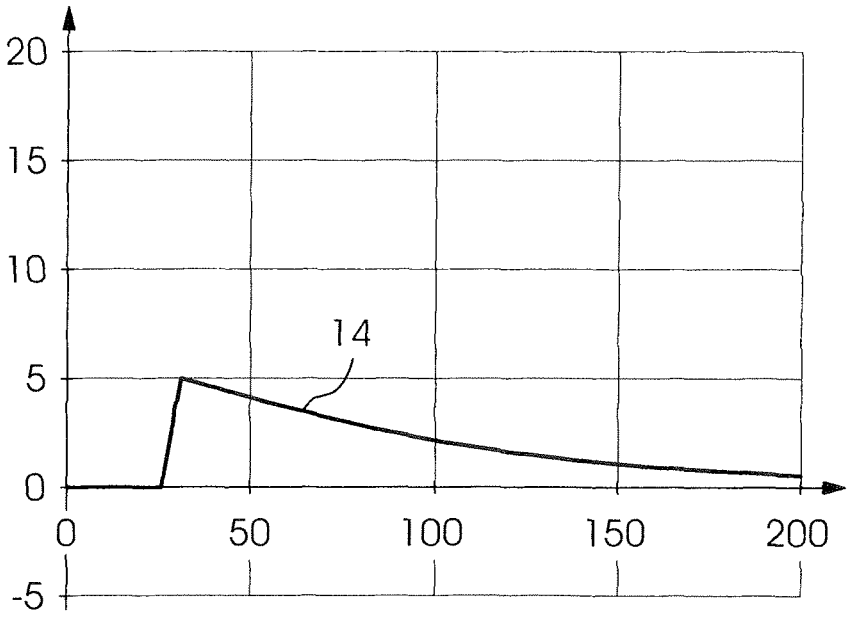

In FIG. 4, an example of an inking overshoot and its effect on the normalized density and the inking gradient for the case of a specific value of the variable in a third value range is shown, in practical terms for the preferred embodiment when the sheet state is "close to the process tolerance." In FIG. 4A, the normalized inking zone opening difference 10 in relation to the inking zone opening in the first steady state (initial state) and the normalized density difference 12 are shown as a function of time, measured in the number of printed sheets. As described above, no overshoot is carried out in this sheet state. The inking zone is opened directly to the value of the final state (for the intended level of inking). The density difference 12 approaches monotonically that in the final state. The latter is only slowly reached. In FIG. 4B, the density gradient 14 is illustrated as a function of time, measured in the number of printed sheets. As already observed in the case of the other sheet states, the density gradient 14 occurs with a time delay in relation to the inking adjustment carried out. The resultant inking spread is in practice so small that it does not gain any visual significance.

In a further development of the preferred embodiment, in addition to the inking, other machine factors are also taken into account for the assessment of the sheet state, so that an overall determination of the sheet state can be carried out. In particular, the machine factors are process variables including printing speed, dampening and register. For each of these variables, in a manner analogous to the inking mentioned above, a division or classification into the states "not saleable," "saleable" and "close to the machine tolerance" is carried out. The sheet state which is taken is then that state which experiences the lowest rating in an individual assessment. This rating of the states is expressed quantitatively by a numerical order: for "not saleable" the value is 0, for "saleable" the value is 1 and for "close to the machine tolerance," the value is 2. As an alternative to the state having the lowest rating, a weighted or unweighted average of the individual ratings can also be defined as a sheet state.

The change in the printing speed has to be taken into account in the further development if it has been increased by more than 3,000 prints/hour. For the printing speed, the following division into states is carried out in the further development: Sheet state "not saleable" for sheets 1 to 50 since a change in the printing speed, sheet state "saleable" for sheets 50 to 100 since the change in the printing speed, sheet state "close to the machine tolerance" for the further sheets beginning from the $100^{th}$ sheet since the change in the printing speed.

The change in the dampening has to be taken into account in the further development if it has been increased by more than 10%. For the dampening, the following division into states is carried out in the further development: sheet state "not saleable" for sheets 1 to 30 since a change in the dampening, sheet state "saleable" for sheets 30 to 60 since the change in the dampening, sheet state "close to the machine tolerance" for the further sheets beginning from the $60^{th}$ sheet since the change in the dampening.

The change in the register has to be taken into account in the further development if it has been adjusted by more than 0.02 mm and/or if more than 0.02 mm register deviations dR from the desired value occur. For the register, the following division into states is carried out in the further development: sheet state "not saleable" for sheets 1 to 20 since a change in the register or in the case of dR>0.02, sheet state "saleable" for sheets 20 to 40 since the change in the register or in the case of dR>0.01, sheet state "close to the machine tolerance" for the further sheets beginning from the $40^{th}$ sheet since the change in the register or in the case of dR<0.01.

The sheet state is then the minimum of the individual sheet states of the process variables.

As already mentioned further above for the preferred embodiment, one further development provides smooth transitions taking place between the states. With regard to the transition between the states "not saleable" and "saleable," as a supplementary parameter, a ratio H of a current inking deviation F_act and a threshold value of the inking deviation F_v is considered: H=F_act/F_v. This supplementary parameter is limited by a maximum H_max: If H>H_max, then H=H_max. A current period D_act and a current level S_act of an overshoot in this transition range are then calculated as follows from a period D_v and a level S_v in the "saleable" state and from a period D_nv and a level S_nv in the "not saleable" state:

$$D_act = D_v + (D_nv - D_v) * (H-1)/(H_max-1) \text{ and}$$

$$S_act = S_v + (S_nv - S_v) * (H-1)/(H_max-1).$$

With regard to the transition between the states "saleable" and "close to the process tolerance," the procedure is analogous. As the supplementary parameter, the ratio H of the current inking deviation F_act and a tolerance value of the inking deviation F_p is considered: H=F_act/F_p. This supplementary parameter is limited by a maximum H_max,p: If H>H_max,p then H=H_max,p. The current period D_act is set equal to the period D_v in the "saleable" state. The current level S_act of an overshoot in this transition range is then calculated as follows from the level S_v in the "saleable" state and the level S_p in the "close to the process tolerance" state:

$$D_act = D_v \text{ and}$$

$$S_act = S_p + (S_v - S_p) * (H - 1)/(H_max,p - 1).$$

Without any measuring instrument and without any approximation, the supplementary parameter H is set equal to the respective maximum.

By way of example, practical values are 80 sheets for D_nv and 40 sheets for D_v. The levels of the overshoots are to be calculated at least as a function of the initial state and of the final state. H_max=2, H_max,p=2, F_v=6% and F_p=3%. Under the assumption that the levels are S_nv=8, S_v=4 and S_p=0, the numerical values listed below result in accordance with the calculation rules described above:

| | | | | | | |
|---|---|---|---|---|---|---|
| F_act | 15% | 10% | 8% | 5% | 4% | 3% |
| H | 2.00 | 1.67 | 1.33 | 1.67 | 1.33 | 1.00 |
| D_act | 40.00 | 53.33 | 66.67 | 80.00 | 80.00 | 80.00 |
| S_act | 8.00 | 6.67 | 5.33 | 2.67 | 1.33 | 0.00 |

The invention claimed is:

1. A method for controlling an inking unit of a printing press having at least one ink metering element and a control unit, the method comprising the following steps:

resetting the ink metering element from a first metered quantity of ink to a second metered quantity of ink for an intended level of inking to be achieved;

setting the ink metering element to a temporary, third metered quantity of ink by the control unit, at least for one time interval, during a non-steady phase of the inking unit before reaching the intended level of inking;

determining a value of a variable describing a measure of a distance of a present level of inking to the intended level of inking on a printing material and predefining a plurality of sets of values for the variable, into which the determined value of the variable can be grouped; and carrying out a temporary metering of the quantity of ink:

at a first rate and/or during a first time period if the value of the variable lies in a first set of values covering states at a relatively large distance from the intended level of inking, and at a second rate, being different from the first rate, and/or in a second time period, being different from the first time period, if the value of the variable lies in a second set of values, being different from the first set of values and covering states at a relatively small distance from the intended level of inking, at least one of the first rate or the second rate being constant.

2. The method for controlling an inking unit of a printing press according to claim 1, which further comprises predefining three mutually different sets of values:

temporary metering of a quantity of ink being carried out at a first rate when the value of the variable lies in the first set of values;

temporary metering of a quantity of ink being carried out at a second rate being smaller than the first rate, when the value of the variable lies in the second set of values; and temporary metering of a quantity of ink being substantially identical to the second metering of a quantity of ink when the value of the variable lies in the third set of values.

3. A method for controlling an inking unit of a printing press having at least one ink metering element and a control unit, the method comprising the following steps:

resetting the ink metering element from a first metered quantity of ink to a second metered quantity of ink for an intended level of inking to be achieved;

setting the ink metering element to a temporary, third metered quantity of ink by the control unit, at least for one time interval, during a non-steady phase of the inking unit before reaching the intended level of inking;

determining a value of a variable describing a measure of a distance of a present level of inking to the intended level of inking on a printing material and predefining a plurality of sets of values for the variable, into which the determined value of the variable can be grouped; and carrying out a temporary metering of the quantity of ink:

at a first rate and/or during a first time period if the value of the variable lies in a first set of values covering states at a relatively large distance from the intended level of inking, and at a second rate, being different from the first rate, and/or in a second time period, being different from the first time period, if the value of the variable lies in a second set of values, being different from the first set of values and covering states at a relatively small distance from the intended level of inking;

providing the first time period of a time interval for the temporary metering of a quantity of ink with a first length when the value of the variable lies in the first set of values; and providing the second time period of a time interval for the temporary metering of a quantity of ink with a second length being greater than the first length.

4. The method for controlling an inking unit of a printing press according to claim 3, wherein the integral of the first rate over the first time period of the time interval is substantially equal to the integral of the second rate over the second time period of the time interval.

* * * * *